US007148457B2

(12) United States Patent
Cotten et al.

(10) Patent No.: US 7,148,457 B2
(45) Date of Patent: Dec. 12, 2006

(54) MICROWAVE WATER HEATING SYSTEM

(75) Inventors: William B. Cotten, Houston, TX (US); Caleob King, Lawrence, KS (US)

(73) Assignee: William Cotten, Houston, TX (US)

( * ) Notice: Subject to any disclaimer, the term of this patent is extended or adjusted under 35 U.S.C. 154(b) by 0 days.

(21) Appl. No.: 10/668,858

(22) Filed: Sep. 23, 2003

(65) Prior Publication Data

US 2005/0061807 A1 Mar. 24, 2005

(51) Int. Cl.
*H05B 6/80* (2006.01)

(52) U.S. Cl. ..... 219/688; 219/678; 219/756; 219/693; 219/748

(58) Field of Classification Search ..... 219/688, 219/748, 687, 679, 759, 701, 757, 689, 746, 219/756, 693, 710; 422/21
See application file for complete search history.

(56) References Cited

U.S. PATENT DOCUMENTS 3,494,724 A * 2/1970 Gray ..... 422/21
3,778,578 A * 12/1973 Long et al. ..... 219/687
4,236,056 A 11/1980 Allen et al.
4,284,869 A 8/1981 Pinkstaff
4,310,738 A 1/1982 Moretti et al.
4,358,652 A 11/1982 Kaarup
4,417,116 A 11/1983 Black
5,247,148 A 9/1993 Mencher
5,683,381 A 11/1997 Carr et al.
6,472,648 B1 10/2002 Matsuo et al.

FOREIGN PATENT DOCUMENTS

GB 2354688 A * 3/2001

* cited by examiner

*Primary Examiner*—Quang Van
(74) *Attorney, Agent, or Firm*—Dale J. Ream

(57) ABSTRACT

A microwave water heating system includes a metal casing having an outer wall defining an interior casing chamber. An inner housing is positioned within the casing and includes an outer wall displaced from the casing outer wall to form an insulating vacuum space. The inner housing includes an inlet port connected to an upstream water source and an outlet port connected to a downstream conduit. The casing and inner housing include generally spherical configurations. The inner housing is configured to induce a vortex of a water stream flowing between inlet and outlet ports. At least one magnetron is mounted to the casing for transmitting microwaves into the inner housing for heating the water stream at the vortex. A float valve in the inner housing allows the water stream to flow and be heated upon demand as the valve operates according to upstream and downstream pressure differentials.

20 Claims, 6 Drawing Sheets

MICROWAVE WATER HEATING SYSTEM

BACKGROUND OF THE INVENTION

This invention relates generally to on-demand water heating systems and, more particularly, to a microwave water heating system that utilizes a vacuum-insulated dual-chambered spherical structure with a plurality of magnetrons for efficiently heating a water stream on-demand with microwaves.

Conventional water heaters consume a significant amount of energy to keep a large volume of water heated for later use. As a result of this energy consumption drawback, in-line systems for heating water only when requested are gaining in popularity. Various on-demand water heating systems have been proposed in the art utilizing microwaves as the heating means. Although assumably effective for their intended purposes, the existing systems are inefficient in both heating a water stream and in preventing loss of that heat energy.

Therefore, it is desirable to have a microwave water heating system that utilizes microwave energy to heat water as demanded by a consumer. Further, it is desirable to have a microwave water heating system for quickly heating a maximum volume of water with a minimal degree of heat loss. Still further, it is desirable to have a microwave water heating system having a strong, lightweight configuration that allows microwave energy to be focused on a central location where a water stream to be heated is swirling in an induced vortex.

SUMMARY OF THE INVENTION

A microwave water heating system according to the present invention includes a metal outer casing having a spherical configuration and an inner housing situated within the outer casing. The inner housing includes an inlet port for connection to an upstream water source and an outlet port for connection to a downstream conduit. A float valve positioned in the inner housing is movable relative to the inlet port between sealed and unsealed configurations according to water pressure differences upstream and downstream of the valve. In other words, the valve is opened when a user turns on a downstream faucet and is closed when the faucet is turned off.

The casing and housing include respective outer walls that are spaced apart with a vacuum space therebetween which forms an insulating layer to prevent heat loss. A plurality of magnetrons are mounted about the casing and positioned to transmit microwaves through the vacuum space and to the inner housing. The inner housing includes a configuration that induces a water stream flowing therein into a vortex for maximum heating thereof by incoming microwaves. A nozzle is situated within the inner housing for delivering the water stream from the vortex to the outlet port as the water stream is being demanded by a user. Thus, the water stream may be efficiently heated on-demand with minimal heat loss due to the spherical and insulating vacuum space configurations.

Therefore, a general object of this invention is to provide a microwave water heating system which heats a volume of water on-demand quickly, efficiently and with minimal heat loss.

Another object of this invention is to provide a microwave water heating system, as aforesaid, which heats a water stream using microwave energy.

Still another object of this invention is to provide a microwave water heating system, as aforesaid, which includes a vacuum space insulating layer to minimize heat loss from heated water.

Yet another object of this invention is to provide a microwave water heating system, as aforesaid, which includes a reflective metal casing for enhancing microwave heating efficiency and minimizing heat loss.

A further object of this invention is to provide a microwave water heating system, as aforesaid, which utilizes heat dissipated by the magnetrons to heat a water stream.

A still further object of this invention is to provide a microwave water heating system, as aforesaid, which utilizes a spherical casing and inner housing configuration to maximize strength, weight, and heating efficiencies.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 2*a* is a side view of the heating system as in FIG. 1;

DESCRIPTION OF THE PREFERRED EMBODIMENT

Figure 1:
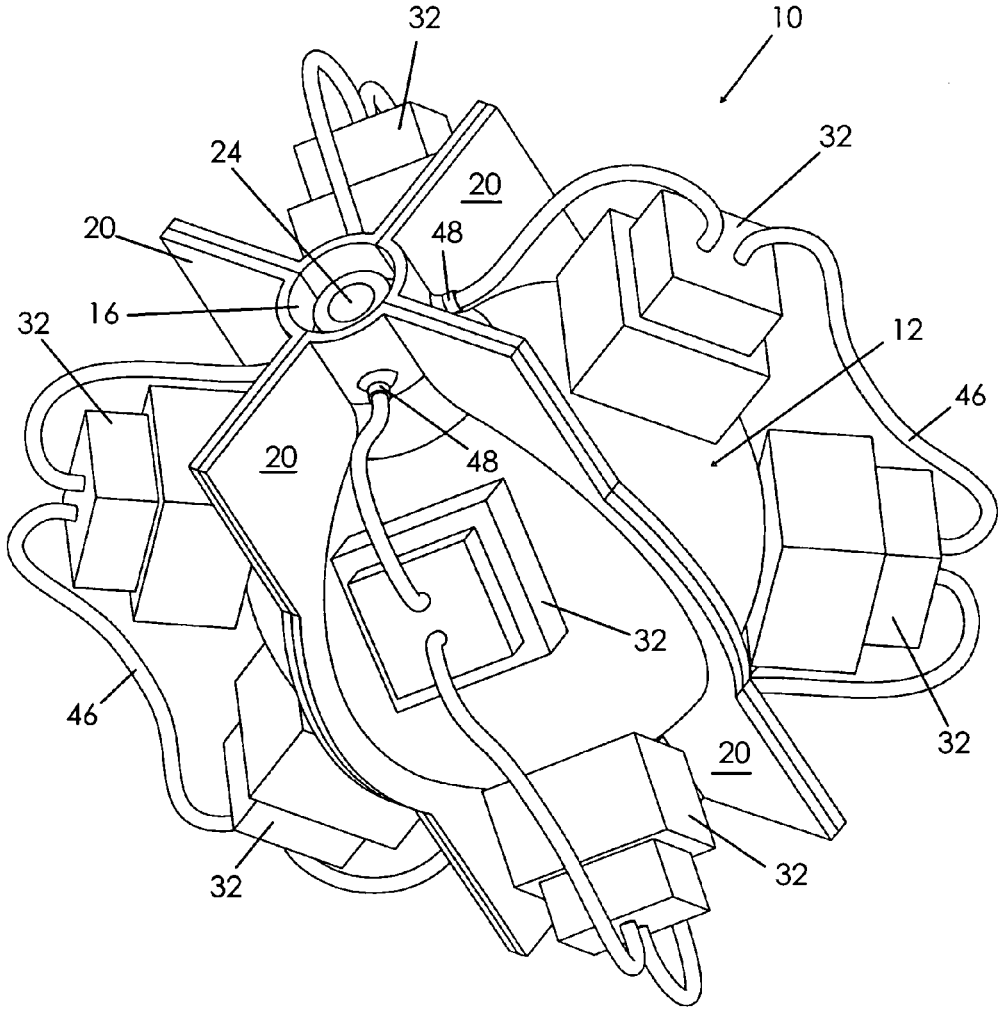
FIG. 1 is a perspective view of a microwave water heating system according to a now preferred embodiment of the present invention.
Figure 2B:
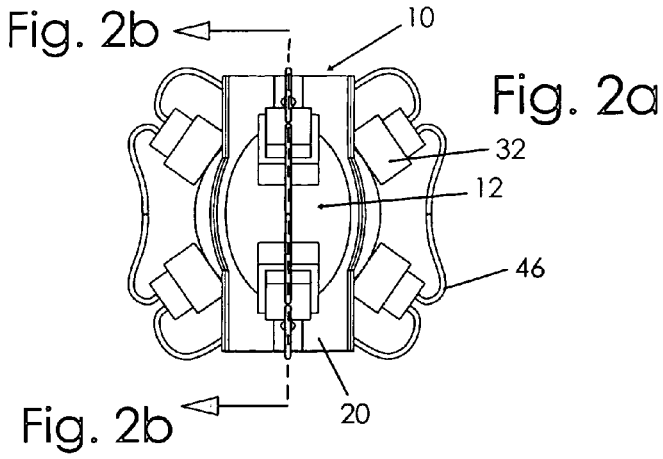
FIG. 2*b* is a sectional view of the heating system taken along line 2*b*—2*b* of FIG. 2*a;*
Figure 2B:
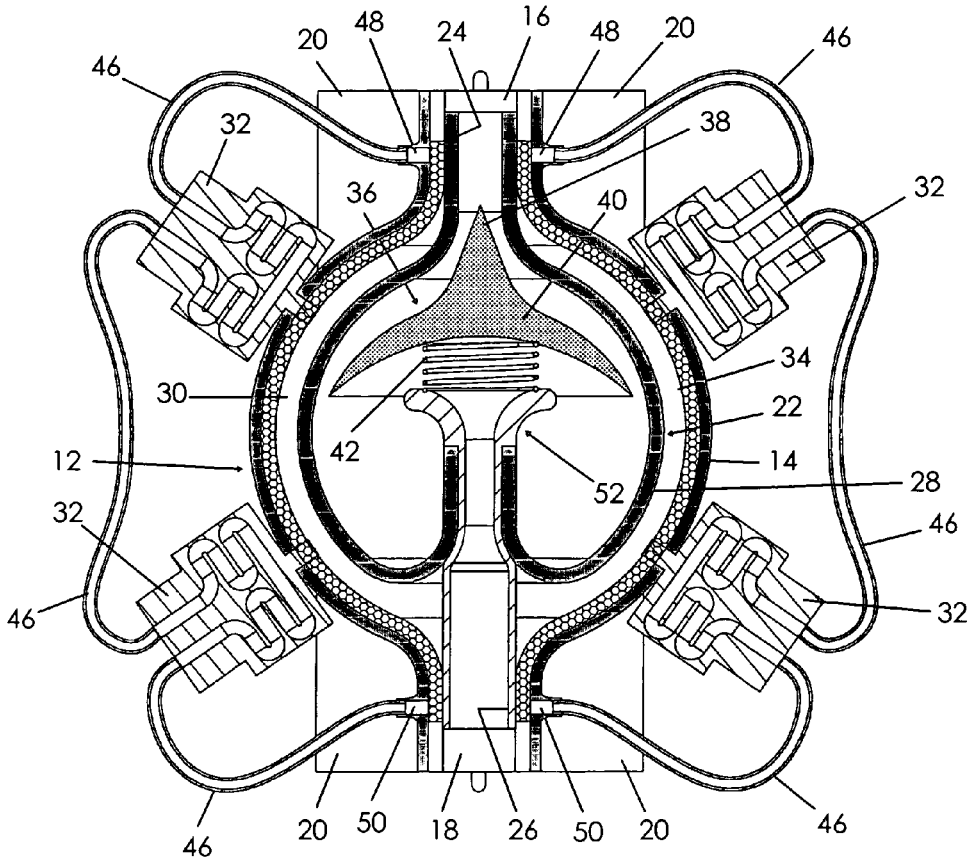

A microwave water heating system 10 according to one embodiment of the present invention will now be described in detail with reference to FIGS. 1 through 4 of the accompanying drawings. As shown in FIGS. 1 and 2*b*, the microwave water heating system 10 includes an outer casing 12 having a metal construction. The casing 12 includes an outer wall 14 preferably having a spherical configuration and defining first 16 and second 18 openings with a casing chamber formed therebetween. The outer casing 12 further includes a plurality of mounting plates 20 connected to the outer wall 14 so that the entire water heating system 10 may be conveniently mounted in-line for use in a water supply system, e.g. below a sink or in a wall adjacent a shower, etc. Of course, other configurations would also work as will be described later.

Further, the microwave water heating system 10 includes an inner housing 22 having a configuration substantially similar to that of the casing 12. Preferably, the inner housing 22 includes a generally spherical configuration concentrically smaller than the casing 12 and positioned within the casing chamber (FIG. 2*b*). The inner housing 22 is preferably constructed of borosilicate glass which has good heat resistant properties although appropriate plastic or other microwave penetrable materials would also be suitable.

Although other configurations would work, as to be described in more detail later, the spherical configuration provides many advantages for the present application. Spherical pressure vessels are the strongest shape for their weight, thus translating into an overall lighter heating apparatus using less material in construction. Further, spherical vessels have the smallest surface area per volume enclosed therein which leads to less heat loss since heat can only be transferred at the surface of the enclosure. Finally, magnetrons radiating energy into a sphere will focus their energy at a common point, namely at the sphere's center, as to be described more fully below.

The inner housing 22 includes an outer wall 28 that is spaced apart from the casing outer wall 14 and forms a vacuum space 30 intermediate the respective outer walls. A vacuum space provides a valuable insulating effect. While heat is not efficiently passed through a vacuum space that is void of air, microwaves are capable of passing through the vacuumed space. Therefore, heating as a result of microwave transmission is capable through a vacuum while heat loss therethrough is very slow. The inner housing 22 includes an inlet port 24 extending through the first opening 16 of the casing 12 for connection to a conventional water source. The inner housing 22 further includes an outlet port 26 extending through the second opening 18 of the casing 12 for connection to a downstream conduit. A water stream is selectively capable of flowing through the housing 22 between the inlet 24 and outlet 26 ports, as will be further described later.

A plurality of magnetrons 32 are mounted to the outer wall 14 of the casing 12 and are spaced apart thereabout (FIG. 1) although the system 10 would work with at least one magnetron. Each magnetron 32 includes a conventional construction and is capable of generating and transmitting microwaves and includes a transmission member extending through the outer wall 14 and directed toward the center of the inner housing 22 (FIG. 2*b*). As described above, the housing 22 is preferably constructed of borosilicate glass such that microwaves being transmitted through the vacuum space 30 and directed at the housing 22 penetrate the housing 22 to heat water therein. With the magnetrons 32 positioned about the spherical-shaped outer wall 14 in a spaced apart relationship relative to one another, the microwaves being transmitted by the magnetrons 32 are focused upon a common central location in the housing 22.

The outer housing 22 includes a reflective inner layer 34 for reflecting microwaves back toward the inner housing 22 if they are previously outwardly reflected. This reflective layer 34 would also reflect microwaves that had passed completely through the inner housing 22. It should be appreciated that this energy and heating efficiency is greater with the spherical configuration of the outer casing and inner housing 22 and with the reflective inner layer 34 than without these design elements.

Figure 3A:
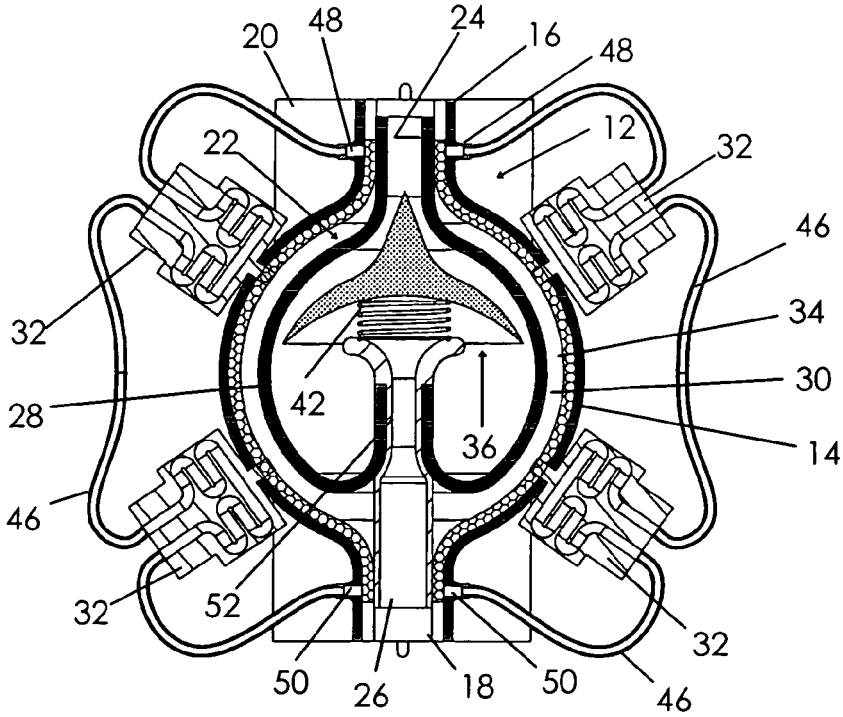
FIG. 3*a* is a sectional view as in FIG. 2*b* with a float valve in an unsealed configuration.
Figure 3B:
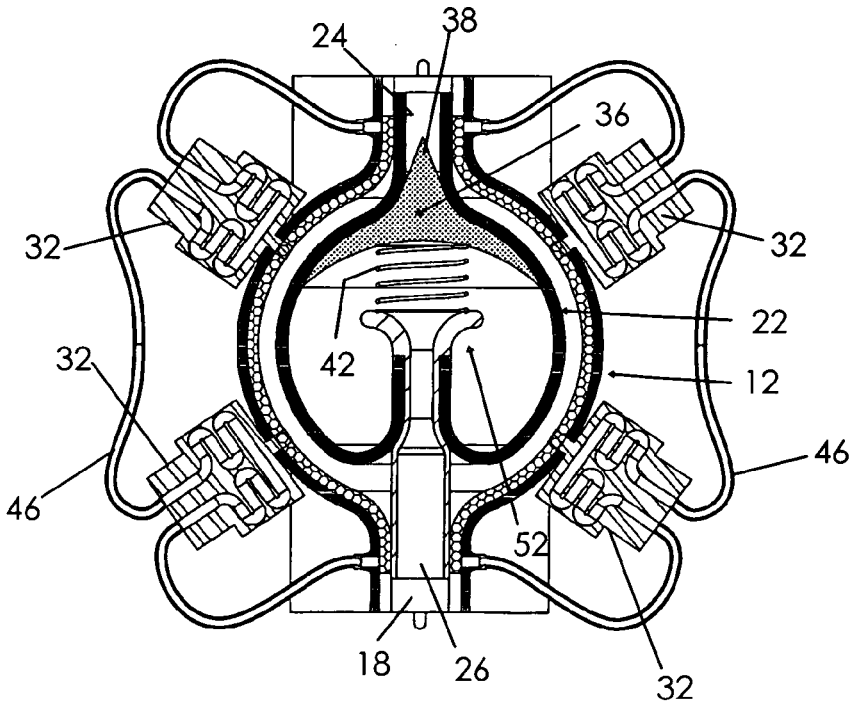
FIG. 3*b* is a sectional view as in FIG. 2*b* with a float valve in a sealed configuration.

A float valve 36 is positioned within the inner housing 22 adjacent the inlet port 24 for regulating the flow of a water stream into the housing 22 from the water source connected to the inlet port 24. The float valve 36 includes a generally cone-shaped tip 38 configured to seal the inlet port 24 when positioned therein. The float valve 36 further includes a generally hemispherical or dome-shaped lower section 40 for directing an inbound water stream outwardly toward the outer wall of the housing 22. The float valve 36 is movable between a sealed configuration (FIG. 3*b*) with the tip 38 nesting within the inlet port 24 and an unsealed configuration (FIG. 3*a*) with the tip 38 displaced from the inlet port 24. The lower section 40 includes a configuration that is complementary to the spherical housing configuration and also contributes to a seal at the sealed configuration (FIG. 3*b*). The float valve 36 is moved between the sealed and unsealed configurations according to differences in upstream and downstream water pressure relative to the float valve 36. In other words, the float valve 36 is drawn in the direction of low pressure so that the water stream flows through the housing 22 between the inlet 24 and outlet 26 ports. For example, the opening of a faucet downstream of the outlet port 26 causes downstream low pressure which draws the float valve 36 in the downstream direction, i.e. causes the float valve 36 to move to its unsealed configuration.

A compression spring 42 is connected at one end to the lower section 40 of the float valve 36 and is mounted at another end to a housing structure as described below. The spring 42 is normally biased to urge the float valve 36 toward the sealed configuration. Thus, the spring 42 is compressed when the float valve 36 moves to the unsealed configuration (FIG. 2*a*) and then returns the valve to the sealed configuration when the downstream low pressure is abated, e.g. upon faucet closing.

Figure 4:
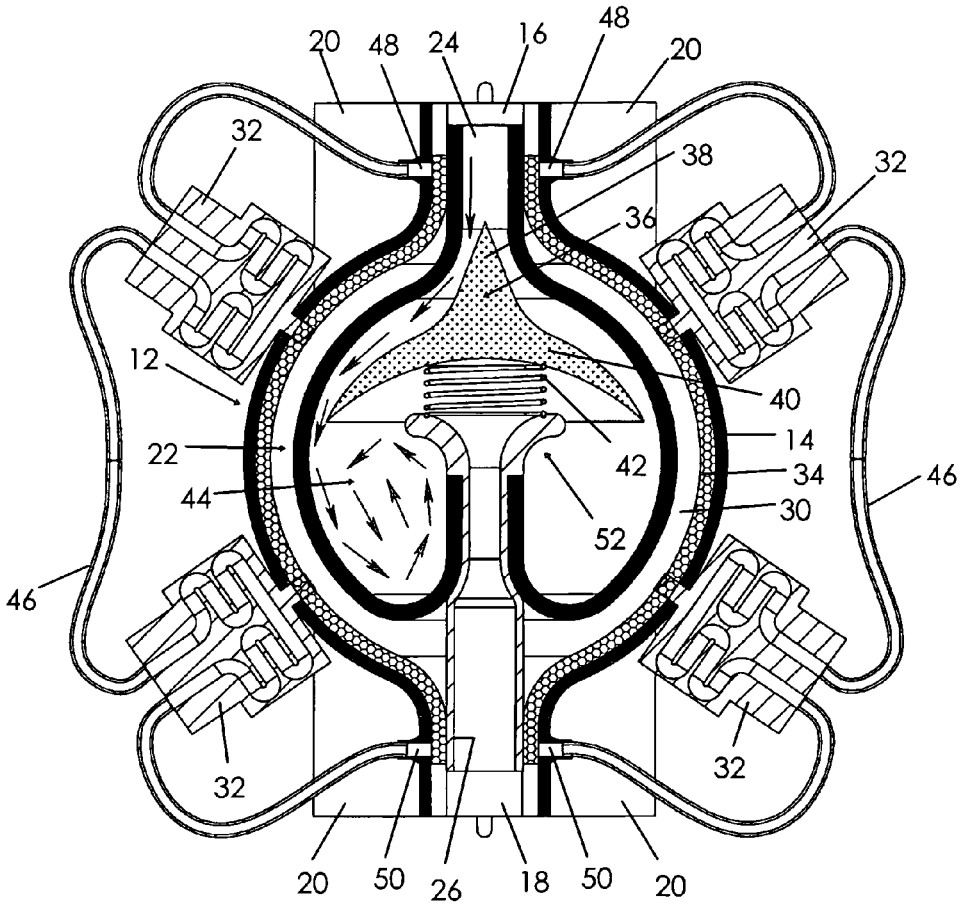
FIG. 4 is a sectional view as in FIG. 3*a* on an enlarged scale showing a flow of a water stream through the system.

The housing 22 includes a bell nozzle 52 extending between a generally central point of the housing and the outlet port 26 for communicating the water stream therebetween (FIG. 2*b*). The bell nozzle 52 includes an open mouth that flares outwardly for efficiently receiving the water stream therein with minimal friction or obstruction. The compression spring 42 is preferably mounted to the nozzle 52 at the nozzle open end for interaction with the lower section 40. It is appreciated that the bell nozzle 52 cooperates with the spherical shape of the housing 22 and flow direction of a water stream as directed by the lower section 40 of the float valve 36 to induce a torroidal vortex 44 within the housing 22 (FIG. 4). Despite the vortex, the water stream is still forced into the mouth of the nozzle 52 by the volume of water entering the housing 22 through the inlet port 24 and as a result of downstream low pressure.

The vortex 44 is important in that this provides more opportunity for the water stream to be heated by incoming microwaves that are being focused at that point. The induced vortex, therefore, contributes to the improved heating efficiency provided by the microwave water heating system 10.

It is recognized that operation of the plurality of magnetrons 32 generates a significant amount of heat which must be dissipated, absorbed, or transferred in some manner. Accordingly, the present invention includes a cooling assembly that makes use of the heat generated by the magnetrons 32 to further heat a water stream for downstream use. More particularly, a conduit 46 is routed through the plurality of magnetrons 32 for a transfer of heat generated thereby to the water stream flowing through the conduit 46. Upstream ends 48 of the conduit 46 are connected to the inlet port 24 of the housing 22 and downstream ends 50 of the conduit 46 are connected to the outlet port 26. Therefore, a portion of the water stream is heated in the housing 22 via microwave transmissions as described previously while another portion of the water stream is heated by dissipated magnetron operation heat. These portions may be reunited at the outlet port 26 and delivered downstream. Alternatively, the cooling assembly may act as a "pre-heater" with that portion being returned to the inlet port 24 to flow through the housing 22 for additional heating.

It is understood that the microwave water heating system 10 may be controlled in a conventional manner. A thermocouple (not shown) may be positioned anywhere along the outlet or downstream tubing with temperature data being relayed to a microcontroller. The microcontroller, then, could activate any number of the plurality of magnetrons 32 to heat a water stream to a desired temperature. The magnetrons 32 may be activated only upon sensing a water flow or may be activated in short bursts to maintain a constant temperature within the housing 22, the housing acting as a conventional hot water storage reservoir.

In use, the microwave water heating system 10 may be installed in a residential or commercial setting as part of the plumbing system. As hot water is demanded, e.g. by opening a faucet or the like, water may be heated using microwaves and delivered to the demanding location. More particularly, upstream and downstream water pressure differentials regulate a float valve's movement between sealed and unsealed configurations. A water stream flowing into the inner housing 22 of the heating system 10 is drawn into a swirl or vortex 44 by the housing, nozzle 52, and float valve 36 configuration where the water stream is subjected to microwaves transmitted from the plurality of magnetrons 32. The microwaves are focused on a common location by their positioning about a generally spherical casing 12 and the microwaves are continuously reflected to the housing 22 by a reflective layer 34 in the casing 12. Heat loss from the housing is minimal in that the housing 22 and casing 12 are separated by a vacuum space 30 for enhanced thermal efficiency.

Figure 5:
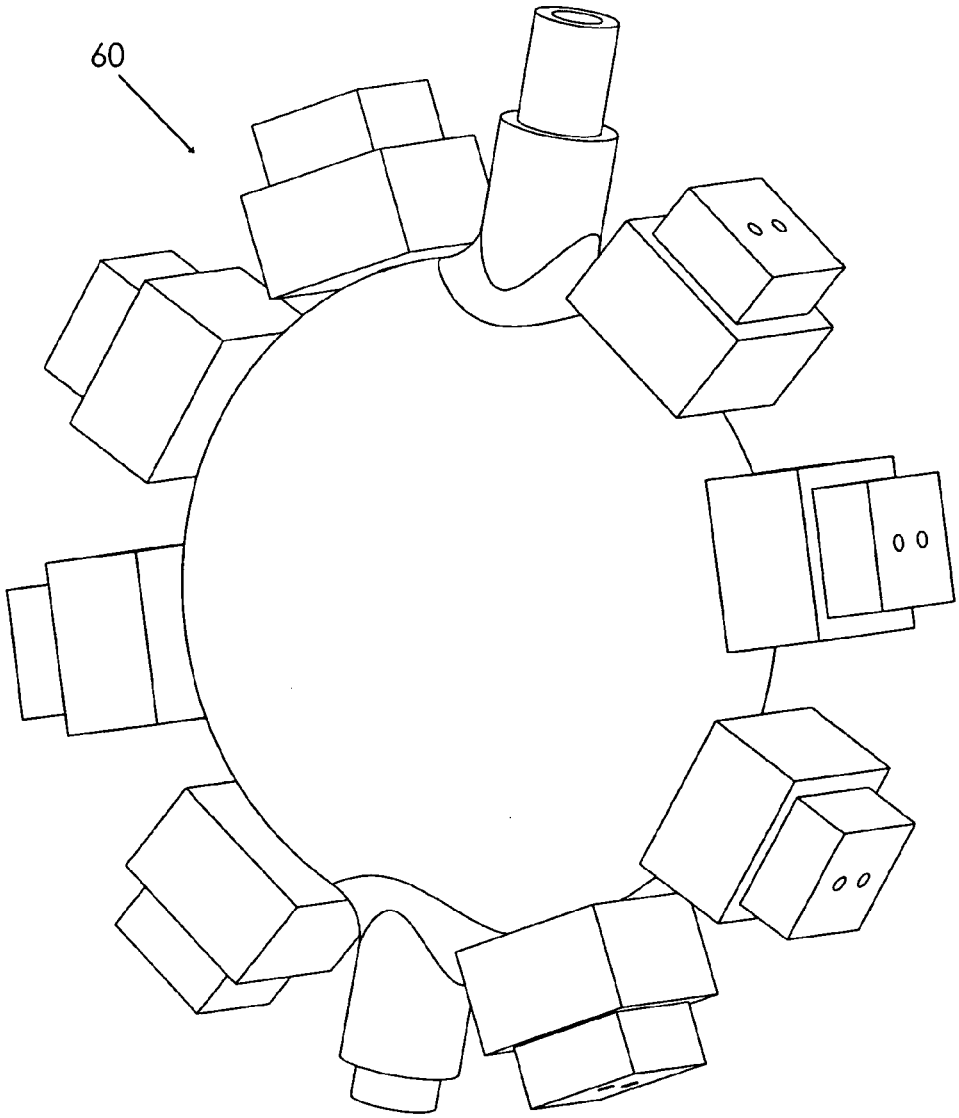
FIG. 5 is a perspective view of a microwave water heating system according to another embodiment of the present invention.

Although a generally spherical configuration is preferred, as described in detail above, alternative casing and housing configurations would also work. A microwave water heating system 60 according to another embodiment of the present invention is shown in FIG. 5 and includes a construction that is substantially similar to the system 10 described previously except as noted below. The system 60 according to this embodiment presents a partially flattened spherical configuration and would maintain many of the advantages of the generally spherical configuration.

Figure 6:
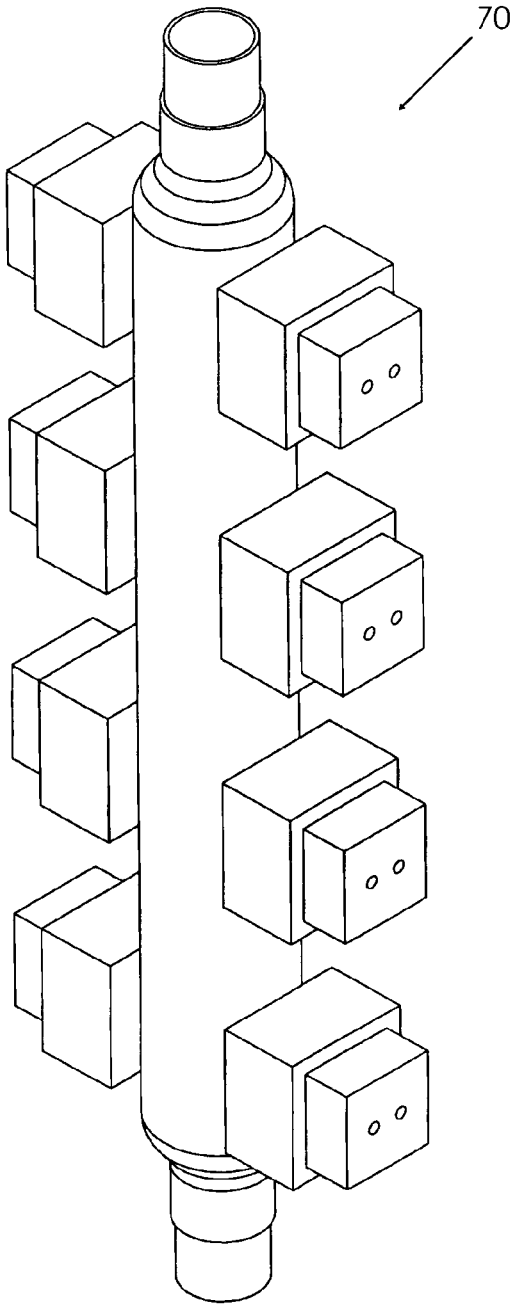
FIG. 6 is a perspective view of a microwave water heating system according to still another embodiment of the present invention.

A microwave water heating system 70 according to still another embodiment is shown in FIG. 6 and includes a generally linear configuration. This configuration would also be suitable although some of the advantages of a spherical configuration, e.g. heat loss reduction and vortex, may be compromised. On the other hand, a linear configuration may work better mounted behind a wall.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A microwave water heating system, comprising:

a metal casing having a casing outer wall defining a casing chamber;

an inner housing positioned in said casing chamber, said inner housing having an inlet port for connection to an upstream water source and having an outlet port, said inner housing being spaced apart from said casing outer wall with a vacuum space; and a magnetron mounted to said casing outer wall for transmission of microwaves through said vacuum space and into said inner housing for heating water therein.

2. The microwave water heating system as in claim 1 wherein:

said casing outer wall defines first and second openings;

said inlet port extends through said first opening and said outlet port extends through said second opening.

3. The microwave water heating system as in claim 1 wherein said inner housing includes a nozzle in fluid communication with said outlet port for delivering a water stream from said housing to said outlet port.

4. The microwave water heating system as in claim 3 wherein said nozzle is a bell nozzle for efficient flow of said water stream.

5. The microwave water heating system as in claim 1 wherein said inner housing includes a configuration for inducing a vortex of a water stream flowing between said inlet and outlet ports.

6. The microwave water heating system as in claim 5 further comprising:

a float valve positioned in said inner housing adjacent said inlet port and movable between a sealed configuration nested in said inlet port and an unsealed configuration displaced from said inlet port according to upstream and downstream water pressure differential; and a compression spring mounted in said inner housing and coupled to said float valve for normally biasing said float valve toward said sealed configuration.

7. The microwave water heating system as in claim 1 wherein:

said casing and said inner housing include generally spherical configurations;

said magnetron includes a plurality of magnetrons spaced apart about said casing, whereby transmission of microwaves thereby are centrally focused toward said inner housing.

8. The microwave water heating system as in claim 1 further comprising means connected to said inlet port for circulating water from said water source through said magnetron for cooling said magnetron.

9. The microwave water heating system as in claim 1 wherein said casing and said inner housing include a partially flattened spherical configuration.

10. The microwave water heating system as in claim 1 wherein said casing and said inner housing include a generally linear configuration.

11. The microwave water heating system as in claim 1 wherein said casing outer wall includes a reflective inner surface for reflecting microwaves toward said inner housing.

12. A microwave water heating system for heating a water stream on demand, comprising:

a metal casing including an outer wall having a generally spherical configuration, said outer wall defining first and second openings and a casing chamber disposed therebetween;

an inner housing positioned in said casing chamber having a generally spherical configuration, said inner housing including an inlet port extending through said first opening for connection to an upstream water source and an outlet port extending through said second opening fur connection to a downstream conduit, whereby a water stream selectively flows through said inner housing between said inlet and outlet ports; and a plurality of magnetrons mounted about said outer wall of said casing and positioned in spaced apart relationship for transmitting microwaves into a center location of said inner housing for heating the water stream; and wherein said inner housing includes an outer wall that is spaced apart from said casing outer wall so as to form an intermediate space therebetween, said intermediate space being a vacuum.

13. The microwave heating system as in claim 12 wherein:

said casing outer wall includes a reflective inner surface for continuously reflecting said microwaves toward said inner housing; and said inner housing includes a construction that is penetrable by microwaves.

14. The microwave water heating system as in claim 12 wherein said inner housing includes a nozzle connected to said outlet port for fluid communication therewith, said outer wall of said inner housing and said nozzle having a configuration for inducing a vortex in the water stream prior to the water stream being discharged through said nozzle to said outlet port, whereby the water stream is heated by said microwaves at said vortex.

15. The microwave water heating system as in claim 14 further comprising a float valve positioned in said inner housing adjacent said inlet port and movable between a sealed configuration nested in said inlet port and an unsealed configuration displaced from said inlet port according to upstream and downstream water pressure differential.

16. The microwave water heating system as in claim 15 further comprising a spring mounted in said inner housing and connected to said float valve for biasing said float valve toward said sealed configuration.

17. The microwave water heating system as in claim 15 further comprising means interconnecting said inlet and outlet ports for circulating water through said plurality of magnetrons, whereby to transfer heat generated by said plurality of magnetrons to the water stream at said outlet port.

18. A microwave water heating system for heating a water stream on demand, comprising:

a metal casing including an outer wall having a generally spherical configuration, said outer wall defining first and second openings and a casing chamber disposed therebetween;

an inner housing positioned in said casing chamber having a generally spherical configuration, said inner housing including an inlet port extending through said first opening for connection to an upstream water source and an outlet port extending through said second opening for connection to a downstream water conduit, whereby a water stream selectively flows through said inner housing between said inlet and outlet ports;

wherein said inner housing includes an outer wall spaced apart from said casing outer wall so as to define a space therebetween, said space being a vacuum;

a plurality of magnetrons mounted about said outer wall of said casing and positioned for transmitting microwaves into said inner housing for heating the water stream;

wherein said inner housing includes a nozzle connected to said outlet port for fluid communication therewith, said outer wall of said inner housing and said nozzle having a configuration for inducing a vortex in the water stream prior to the water stream being discharged through said nozzle and said outlet port, whereby the water stream is heated by said microwaves at said vortex.

19. The microwave water heating system as in claim 18 further comprising a float valve positioned in said inner housing adjacent said inlet port and movable between a sealed configuration nested in said inlet port and an unsealed configuration displaced from said inlet port, said float valve moving between said sealed and unsealed configurations according to a water pressure difference upstream and downstream of said float valve.

20. The microwave heating system as in claim 19 further comprising a spring mounted in said inner housing and connected to said float valve for biasing said float valve toward said sealed configuration.

* * * * *